US006770617B2

(12) United States Patent
Ushio et al.

(10) Patent No.: US 6,770,617 B2
(45) Date of Patent: Aug. 3, 2004

(54) SOFTENER COMPOSITION

(75) Inventors: Noriaki Ushio, Wakayama (JP); Atsushi Yamamoto, Wakayama (JP); Shuji Tagata, Wakayama (JP); Nobuyuki Ogura, Wakayama (JP)

(73) Assignee: Kao Corporation, Tokyo (JP)

( * ) Notice: Subject to any disclaimer, the term of this patent is extended or adjusted under 35 U.S.C. 154(b) by 169 days.

(21) Appl. No.: 10/114,949

(22) Filed: Apr. 4, 2002

(65) Prior Publication Data

US 2002/0198129 A1 Dec. 26, 2002

(30) Foreign Application Priority Data

| | | |
|---|---|---|
| Apr. 11, 2001 | (JP) | 2001-112692 |
| Apr. 11, 2001 | (JP) | 2001-112693 |
| Aug. 3, 2001 | (JP) | 2001-236377 |
| Aug. 3, 2001 | (JP) | 2001-236378 |

(51) Int. Cl.[7] ..... C11D 1/65
(52) U.S. Cl. ..... 510/496
(58) Field of Search ..... 510/495, 496, 510/498, 504

(56) References Cited

U.S. PATENT DOCUMENTS

| | | | | |
|---|---|---|---|---|
| 5,019,280 A | | 5/1991 | Caswell et al. | |
| 5,415,812 A | * | 5/1995 | Durbut et al. | 510/365 |
| 6,528,070 B1 | * | 3/2003 | Bratescu et al. | 424/401 |

FOREIGN PATENT DOCUMENTS

| | | |
|---|---|---|
| EP | 0 315 126 A2 | 5/1989 |
| GB | 2 007 735 A | 5/1979 |
| JP | 54-160890 | 12/1979 |
| JP | 5132865 | 5/1993 |
| JP | 7268773 | 10/1995 |
| JP | 07264495 | 4/1997 |
| WO | WO 95/29218 | 11/1995 |
| WO | WO 97/34972 | 9/1997 |
| WO | WO 99/27050 | 6/1999 |

* cited by examiner

*Primary Examiner*—John R. Hardee
(74) *Attorney, Agent, or Firm*—Birch, Stewart, Kolasch & Birch, LLP

(57) ABSTRACT

Provided is a transparent softener composition having a high softening effect and imparting good feeling to clothes. The composition comprises (a) a compound having one group selected from an amino group and a quaternary ammonium group and one hydrocarbon group having 8 to 36 carbon atoms in its molecule, (b) an anionic surfactant having a hydrocarbon group having 14 to 36 carbon atoms and a —$SO_3M$ group and/or a —$OSO_3M$ group [M: counter ion] in its molecule, (c) an organic solvent having a log P of 0.2 to 3.0 and water, wherein (a)/(b) is a specified molar ratio, or comprises (a") a compound having one group selected from an amino group and a quaternary ammonium group and one hydrocarbon group having 8 to 36 carbon atoms in its molecule and (b") an anionic surfactant having a hydrocarbon group having 8 to 36 carbon atoms and a —$SO_3M$ group and/or a —$OSO_3M$ group (M: counter ion) in its molecule wherein at least one of (a") and (b") contains a hydrocarbon group selected from (1) a hydrocarbon group having one or more unsaturated bonds and 8 to 36 carbon atoms and (2) a branched alkyl group having 8 to 36 carbon atoms.

3 Claims, No Drawings

SOFTENER COMPOSITION

TECHNICAL FIELD OF THE INVENTION

The present invention relates to a softener composition.

PRIOR ART

A quaternary ammonium salt having a long-chain alkyl group or an acid salt of a tertiary amine is conventionally used for softeners. These softeners have a good softening effect on various fabrics even if they are used in a small amount. However, these softeners are known to make fabrics oily finish and therefore softeners improving the feeling of fabrics have been desired.

In order to dissolve this drawback, a method in which a combination of a dialkyl quaternary ammonium compound and an anionic surfactant is used is disclosed in JP-B No. 61-37387 and a softener composition comprising a combination of a softening component having two or more cationic ions in its molecule and an anionic surfactant is disclosed in JP-A No. 9-111660. However, these technologies cannot succeed in compatibility between the flexibility and the feeling of finished fabric.

Also, studies have been made as to a development of a softener composition made its outward appearance transparent in recent years from an aesthetic point of view. In JP-A No. 11-507095, technologies using a specified softener compound having an alkenyl group and a solvent having a specified Clog P value are disclosed. However, even if such technologies are used, only an insufficient effect of improving the feeling of fabric is obtained.

Meanwhile, it has been already known that a mono long-chain alkyl tertiary amine is used for a softener. In the publication of JP-A No. 7-268773, a softener composition using a mono long-chain alkyl tertiary amine having an ester group or an amide group and a specified ester compound. Also, in the publication of JP-A No. 5-132865, a softener composition is disclosed in which an amine compound and an anionic surfactant are carried on a substrate in the condition that the both are not mixed. However, oily feeling cannot be improved even in the compositions disclosed in these publications and no liquid softener composition of which outward appearance is transparent cannot be provided.

WO99/27050 shows a transparent softener, which comprises softening materials, a solvent having a log P of −2.0 to 2.6 and an electrolyte.

DISCLOSURE OF THE INVENTION

It is an object of the present invention to provide a transparent softener composition which has a high softening effect and imparts desirable feeling to clothes.

The invention provides a softener composition comprising (α) an amino compound or a quaternary ammonium-having compound, (β) an anionic surfactant and water, (α) and (β) being specified below as (I) or (II), at a mole ratio of (α)/(β) ranging from 9/1 to 4/6, further comprising an organic solvent having a log P of 0.2 to 3.0 when (α) and (β) are specified as (I):

(I) (a) a compound having one group selected from an amino group and a quaternary ammonium group and one hydrocarbon group having 8 to 36 carbon atoms in its molecule and (b) an anionic surfactant having a hydrocarbon group having 14 to 36 hydrocarbons and a —$SO_3M$ group and/or a —$OSO_3M$ group, M being a counter ion, in its molecule, or;

(II) (a") a compound having one group selected from an amino group and a quaternary ammonium group and one hydrocarbon group having 8 to 36 carbon atoms in its molecule and (b") an anionic surfactant having a hydrocarbon group having 8 to 36 carbon atoms and a —$SO_3M$ group and/or a —$OSO_3M$ group, M being a counter ion, in its molecule wherein at least one of (a") and (b") contains a hydrocarbon group selected from (1) a hydrocarbon group having one or more unsaturated bonds and 8 to 36 carbon atoms and (2) a branched alkyl group having 8 to 36 carbon atoms.

It is preferable that in the above shown composition (α) and (β) may form a complex with each other.

The embodiment (I) of the present invention is, to say in other words, a softener composition comprising (a) a compound [hereinafter referred to as a component (a)] having one group selected from an amino group and a quaternary ammonium group and one hydrocarbon group having 8 to 36 carbon atoms in its molecule and (b) an anionic surfactant [hereinafter referred to as a component (b)] having a hydrocarbon group having 14 to 36 carbon atoms and a —$SO_3M$ group and/or a —$OSO_3M$ group [M: counter ion] in its molecule, (c) an organic solvent [hereinafter referred to as a component (c)] having a log P of 0.2 to 3.0 and water, wherein (a)/(b) is 9/1 to 4/6 in terms of molar ratio.

The hydrocarbon group of (b) may have 16 to 36 carbon atoms and (c) has a log P of 0.5 to 3.0.

The embodiment (II) of the present invention relates to a softener composition comprising (a") a compound [hereinafter referred to as a component (a") having one group selected from an amino group and a quaternary ammonium group and one hydrocarbon group having 8 to 36 carbon atoms in its molecule, (b") an anionic surfactant [hereinafter referred to as a component (b")] having a hydrocarbon group having 8 to 36 carbon atoms and a —$SO_3M$ group and/or a —$OSO_3M$ group (M: counter ion) in its molecule and water wherein the molar ratio of (a")/(b") is 9/1 to 4/6 and at least one of (a") and (b") contains at least one hydrocarbon group selected from (1) a hydrocarbon group having one or more unsaturated bonds and 8 to 36 carbon atoms and (2) a branched alkyl group having 8 to 36 carbon atoms.

As to the components (a") and (b") of the present invention, either both or any one of these components and preferably any one of these components are contained and most preferably the component (b") contains at least one hydrocarbon group selected from (1) a hydrocarbon group (hereinafter referred to as a hydrocarbon group (1)) having one or more unsaturated bonds and 8 to 36 and preferably 14 to 26 carbon atoms and (2) a branched alkyl group (hereinafter referred to as a hydrocarbon group (2)) having 8 to 36 and preferably 12 to 26, more preferably 14 to 26 carbon atoms). Also in the case where the component (a") and/or the component (b") are used in plural, at least any one of the compounds may contain at least one hydrocarbon group selected from the hydrocarbon group (1) and the hydrocarbon group (2). The hydrocarbon group (1) may contain a branched chain.

As the hydrocarbon group (1), an oleyl group, elaidyl group, linol group, linolenyl group, erucyl group and brassidyl group are preferable. Also, as the hydrocarbon group (2), an isostearyl group, isooleyl group and Guerbet type alkyl group are preferable. An oleyl group and erucyl group as the hydrocarbon group (1) and an isostearyl group and Guerbet type alkyl group as the hydrocarbon group (2) are more preferable in view of feeling.

Also, these hydrocarbon groups (1) and (2) may be connected with a quaternary ammonium group and/or an amino group used as the component (a") or an anionic group used as the component (b") through an ester group, ether group or amide group. Concretely, a group represented by R'—[T—R"]$_b$— [wherein R' represents a hydrocarbon group selected from the hydrocarbon group (1) and the hydrocarbon group (2), T represents a group selected from —COO—, —OCO—, —CONH— and —NHCO, R" represents an alkylene group having 1 to 5 carbon atoms and h denotes a number of 0 or 1] is preferable.

DETAILED DESCRIPTIONS OF THE INVENTION

<Component (a)>

As the component (a) according to the present invention, one or more types selected from a tertiary amine represented by the following formula (I) or its salt and a quaternary ammonium salt represented by the formula (2) are preferable.

(1)

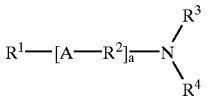

(2)

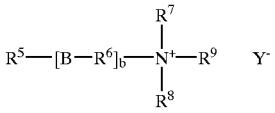

wherein $R^1$ and $R^5$ independently represent an alkyl group or an alkenyl group having 8 to 36 carbon atoms, $R^2$ and $R^6$ independently represent an alkylene group having 1 to 6 carbon atoms, $R^3$, $R^4$, $R^7$, $R^8$ and $R^9$ independently represent an alkyl group or a hydroxyalkyl group having 1 to 3 carbon atoms, A and B independently represent a group selected from —COO—, —OCO—, —CONH— and —NHCO—, a and b independently denote a number of 0 or 1 and Y represents an anion.

$R^1$ in the compound of the formula (I) is an alkyl group or alkenyl group having 8 to 36 and preferably 14 to 24 carbon atoms and preferably an alkyl group. $R^2$ is preferably an alkylene group having 1 to 4 carbon atoms. It is preferable that $R^3$ and $R^4$ be independently a methyl group, ethyl group or hydroxyethyl group. a is preferably 1. As most preferable compounds among the compounds of the formula (1), one or more types selected from compounds represented by the following formula (1-1) and compounds represented by the following formula (1-2) are exemplified.

(1-1)

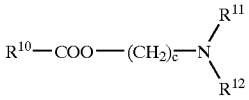

(1-2)

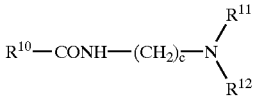

wherein $R^{10}$ represents an alkyl group or an alkenyl group having 9 to 35, preferably 15 to 23 and more preferably 17 to 21 carbon atoms, c denotes 2 or 3, $R^{11}$ and $R^{12}$ independently represent a methyl group, an ethyl group or a hydroxyethyl group and preferably a methyl group or a hydroxyethyl group.

The compounds represented by the formula (1-1) and formula (1-2) maybe easily synthesized by reacting a fatty acid re presented by $R^{10}$—COOH, an alkyl (1 to 5 carbon atoms) ester thereof or an acid chloride thereof with an N-hydroxyalkyl-N,N-dialkylamine or N-aminoalkyl-N,N-dialkylamine, wherein $R^{10}$ may be either a single alkyl chain length or a mixed alkyl chain length.

The compound of the formula (1) may be a salt neutralized by an inorganic or organic acid. Also, in the case of using the compound as a salt, one in which the amino group is neutralized by an acid agent before the compound is compounded in the softener composition may be used. The amino group may be neutralized by an acid agent after the component (a) is compounded in the softener composition. As the acid for neutralization, hydrochloric acid, sulfuric acid, phosphoric acid, glycolic acid, hydroxycarboxylic acid, citric acid, a sulfonic acid having an aromatic group in the molecule, a carboxylic acid, a fatty acid having 1 to 12 carbon atoms or an alkylsulfuric acid having 1 to 3 carbon atoms is preferable and particularly, hydrochloric acid, sulfuric acid, glycolic acid, citric acid or p-toluene sulfonic acid is preferable. These acid agents used for neutralization may be used either singly or in plural.

$R^5$ in the compound of the formula (2) is an alkyl group or an alkenyl group having 8 to 36 carbon atoms and preferably 14 to 24 carbon atoms. $R^6$ is preferably an alkylene group having 1 to 4 carbon atoms. It is preferable that $R^7$, $R^8$ and $R^9$ be independently a methyl group, ethyl group or hydroxyethyl group. As a particularly preferable compound among the compounds of the formula (2), one or more types selected from compounds represented by the following formula (2-1) and compounds represented by the formula (2-2) are exemplified.

(2-1)

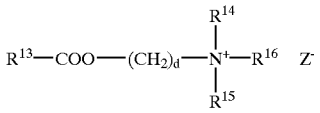

(2-2)

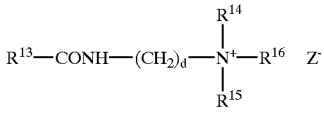

wherein $R^{13}$ represents an alkyl group or an alkenyl group having 9 to 35 and preferably 15 to 23, more preferably 17 to 21 carbon atoms and preferably an alkyl group, d is 2 or 3, $R^{14}$, $R^{15}$ and $R^{16}$ independently represent a methyl group, an ethyl group or a hydroxyethyl group and preferably a methyl group or a hydroxyethyl group, $Z^-$ represents an anion and preferably one or more types selected from a halogen ion, a sulfuric acid ion, a phosphoric acid ion, an alkyl sulfate ion having 1 to 3 carbon atoms, a fatty acid ion having 1 to 12 carbon atoms and an arylsulfonic acid ion which may be substituted with an alkyl group having 1 to 3 carbon atoms.

These compounds of the formulae (2-1) and (2-2) can be easily synthesized by reacting a fatty acid represented by $R^{13}$—COOH or its alkyl (1 to 5 carbon atoms) ester or acid chloride with an N-hydroxyalkyl-N,N-dialkylamine or N-aminoalkyl-N,N-dialkylamine and by further making the resulting product into a quaternary compound by using an alkylating agent such as an alkyl halide, dialkylsulfuric acid or alkylene oxide. These compounds of the formulae (2-1) and (2-2) can also be synthesized by reacting an N,N,N-trialkyl-N-hydroxyalkyl quaternary ammonium salt or N,N,N-trialkyl-N-aminoalkyl quaternary ammonium salt with a fatty acid represented by $R^{13}$—COOH or its alkyl (1 to 5 carbon atoms) ester or acid chloride. $R^{13}$ may be either a single alkyl chain length or a mixed alkyl chain length.

The component (a) of the present invention is preferably the compound of the formula (1) or a combination of the compound of the formula (1) and the compound of the formula (2) in view of softening effect. In the case of using the combination, the ratio by weight of the compound of the formula (1) and the compound of the formula (2) is preferably 1/1000 to 1000/1.

<Component (b)>

The component (b) of the present invention is an anionic surfactant containing an alkyl group or an alkenyl group having 14 to 36, preferably 16 to 26 and particularly preferably 18 to 26 carbon atoms and a —$SO_3M$ group and/or —$OSO_3M$ group [M: counter ion] in its molecule. Specifically, an alkylbenzenesulfonic acid, alkyl (or alkenyl) sulfate, polyoxyalkylene alkyl (or alkenyl) ether sulfate, olefin sulfonic acid, alkanesulfonic acid, α-sulfofatty acid and α-sulfofatty acid ester wherein the alkyl group or the alkenyl group has the same carbon number as above and salts of these compounds are preferable. It is the most preferable to incorporate at least one selected from an alkylsulfate having a straight alkyl having 16 to 22 carbon atoms, an alkylsulfate having a branched alkyl having 18 to 26 carbon atoms and a salt thereof. Among these compounds, it is preferable to formulate one or more types selected from, particularly an alkyl (or alkenyl) sulfate having an alkyl group or an alkenyl group having 16 to 26 carbon atoms and particularly 18 to 26 carbon atoms, polyoxyethylenealkyl (or alkenyl) ether sulfate which has an alkyl group or an alkenyl group having 16 to 26 carbon atoms and in which the average number of addition mols of ethylene oxide (hereinafter referred to as EO) is 1 to 6, preferably 1 to 4 and particularly preferably 1 to 3 and salts of these compounds. As the salt, sodium salt, potassium salt, ammonium salt and an alkanol amine salt and magnesium salt are preferable from the point of view of storage stability.

<Component (a")>

As the component (a") of the present invention, one or more types selected from a tertiary amine represented by the following formula (1') or its salt and a quaternary ammonium salt represented by the formula (2) are preferable.

(1')

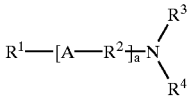

(2')

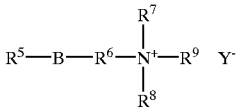

wherein $R^1$ and $R^5$ independently represent a group selected from the hydrocarbon group (1), the hydrocarbon group (2) and (3) a straight-chain alkyl group (hereinafter referred to as a hydrocarbon group (3)) having 8 to 36 and preferably 14 to 26 carbon atoms and $R^2$, $R^6$, $R^3$, $R^4$, $R^7$, $R^8$, $R^9$, A, B, a and $Y^-$ are the same as those in the formulae (1) and (2).

In the compound of the formula (1'), $R^2$ is preferably an alkylene group having 1 to 4 carbon atoms. Preferably $R^3$ and $R^4$ are independently a methyl group, ethyl group or hydroxyethyl group. a is preferably 1. As particularly preferable compounds among the compounds of the formula (1'), one or more types selected from compounds represented by the following formula (1'-1) and compounds represented by the formula (1'-2) are exemplified.

(1'-1)

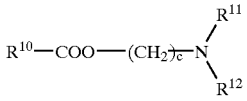

(1'-2)

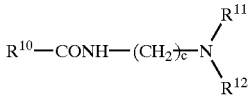

wherein $R^{10}$ represents a group selected from the hydrocarbon group (1), the hydrocarbon group (2) and the hydrocarbon group (3), c is 2 or 3 and $R^{11}$ and $R^{12}$ independently represent a methyl group, an ethyl group or a hydroxyethyl group and preferably a methyl group or a hydroxyethyl group.

$R^6$ in the compound of the formula (2') is preferably an alkylene group having 1 to 4 carbon atoms. It is preferable that $R^7$, $R^8$ and $R^9$ be independently a methyl group, an ethyl group or a hydroxyethyl group. As particularly preferable compound among the compounds of the formula (2'), one or more types selected from compounds represented by the following formula (2'-1) and compounds represented by the following formula (2'-2) are exemplified.

(2'-1)

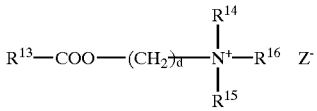

(2'-2)

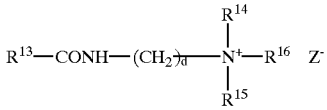

wherein $R^{13}$ represents a group selected from the hydrocarbon group (1), the hydrocarbon group (2) and the hydrocarbon group (3), d is 2 or 3, $R^{14}$, $R^{15}$ and $R^{16}$ independently represent a methyl group, an ethyl group or a hydroxyethyl group and preferably a methyl group or a hydroxyethyl group, $Z^-$ represents an anion and preferably one or more types selected from a halogen ion, a sulfuric acid ion, a phosphoric acid ion, an alkyl sulfate ion having 1 to 3 carbon atoms, a fatty acid ion having 1 to 12 carbon atoms and an arylsulfonic acid ion which may be substituted with an alkyl group having 1 to 3 carbon atoms.

<Component (b")>

The component (b") of the present invention preferably contains a group selected from the hydrocarbon group (1), the hydrocarbon group (2) and the hydrocarbon group (3) and more preferably a group selected from the hydrocarbon group (1) and the hydrocarbon group (2) in its molecule. Specifically, an alkylbenzenesulfonic acid, alkyl (or alkenyl) sulfate, polyoxyalkylene alkyl (alkenyl) ether sulfate, olefinsulfonic acid, alkanesulfonic acid, α-sulfofatty acid and α-sulfofatty acid ester having above-mentioned hydrocarbon and salts of these compounds are preferable. Among these compounds, it is particularly preferable to formulate one or more types selected from an alkyl (or alkenyl) sulfate having a group selected from the hydrocarbon group (1) and hydrocarbon group (2), a polyoxyethylene alkyl (alkenyl) ether sulfate which has a group selected from the hydrocarbon group (1) and the hydrocarbon group (2) and in which the average number of addition mols of ethylene oxide (hereinafter referred to as EO) is 1 to 6, preferably 1 to 4 and particularly preferably 1 to 3 and salts of these compounds. As the salts, a sodium salt, potassium salt, ammonium salt and alkanolamine salt are preferable from the point of view of storage stability.

The compounds of the formulae (1'-1) and (1'-2) may be synthesized in the same manner as in the case of the formulae (1-1) and (1-2). The compound of the formula (1') maybe a salt neutralized in the same manner as in (1). The compounds of the formulae (2'-1) and (2'-2) maybe synthesized in the same manner as in the case of the formulae (2-1) and (2-2). As the component (a') in the present invention, the compound of the formula (1') or a combination of the compound of the formula (1') and the compound of the formula (2') in the same ratio as in (a) is preferable in view of softening effect.

<Component (c)>

The embodiment (I) of the present invention contains the component (c).

The embodiment (II) of the present invention preferably contains the component (c).

The component (c) in the present invention uses an organic solvent having a log P of 0.2 to 3, preferably 0.5 to 3, more preferably 0.5 to 2 and particularly preferably 0.5 to 1.9, most preferably 0.5 to 1.6. Here, the aforementioned log P is a factor indicating the affinity of an organic compound to water and 1-octanol. The 1-octanol/water distribution coefficient P is the ratio of the equilibrium concentrations of a compound in each solvent in the state of distribution equilibrium when a small amount of the compound is dissolved as a solute in a solvent of two liquid phases consisting of 1-octanol and water and is generally expressed in the form of a logarithmic value of the ratio, namely, log P to the base 10. The value of each log P of many compounds has been reported. Many values are reported in the Data Base available from Daylight Chemical Information Systems, Inc. (Daylight CIS) and so on and these documents may be adopted as references. When there is no actual value of log P, it is most convenient to calculate the value by using a program "CLOGP" available from Daylight CIS. This program also outputs the value of "calculated log P (Clog P)" calculated by Fragment Approach of Hansch, Leo when there is an actual value of log P. This Fragment Approach is based on the chemical structure of a compound and takes the number of atoms and the type of chemical bond into account (cf. A. Leo, Comprehensive Medicinal Chemistry, Vol. 4, C. Hansch, P. G. Sammens, J. B. Taylor and C. A. Ramsden, Eds., p.295, Pergamon Press, 1990). Because this value of Clog P is an estimate which is most popular and reliable at present, it may be used in place of its actual value of log P when selecting a compound. In the present invention, if there was an actual value of log P, it was used whereas if there was no actual value, a value of Clog P calculated using the program CLOGP v4.01 was used.

As the organic solvent having such a log P, compounds represented by the following formulae (3), (4) and (5) are preferable.

$$R^{17}—OH \quad (3)$$

wherein $R^{17}$ represents a hydrocarbon group having 4 to 8 carbon atoms and preferably an alkyl group, an alkenyl group or an arylalkyl group.

$$R^{18}—(O—R^{19})_f—O—R^{20} \quad (4)$$

wherein $R^{18}$ and $R^{20}$ respectively represent a hydrogen atom, $R^{21}CO—$ (where $R^{21}$ represents an alkylene group having 1 to 3 carbon atoms) or a hydrocarbon group having 1 to 7 carbon atoms and preferably a hydrogen atom, an alkylene group, an aryl group or an arylalkyl group, $R^{20}$ represents an alkylene group having 2 to 9 carbon atoms and f is a number from 1 to 5.

$$R^{22}—O—CH_2CH(O—R^{23})CH_2—O—R^{24} \quad (5)$$

wherein $R^{22}$ represents an alkyl group having 3 to 8 carbon atoms and $R^{23}$ and $R^{24}$ respectively represent a hydrogen atom or an alkyl group having 1 to 3 carbon atoms and may be substituted with a hydroxy group.

More concretely, preferable examples of the compound include n-propanol, n-butanol, 1-butanol, 2-butanol, n-hexanol, cyclohexanol, phenol, benzyl alcohol, phenethyl alcohol, 2-phenoxyethanol, 2-benzyloxyethanol, diethylene glycol monobenzyl ether, diethylene glycol monophenyl ether, triethylene glycol monophenyl ether, 2-ethylhexane-1,3-diol, nonane-1,9-diol, 2-methyloctane-1,8-diol, 2-butoxyethanol, diethylene glycol monobutyl ether, triethylene glycol monobutyl ether, 2-(2-methyl)propoxyethanol, diethylene glycol mono-2-methylpropyl ether, 2-propoxy-1-propanol, dipropylene glycol monopropyl ether, 2-butoxy-1-propanol, dipropylene glycol monobutyl ether, 2-t-butoxy-1-propanol, 2-phenoxy-1-propanol, 2-ethoxypropyl-1-acetate, 2-propoxypropyl-1-acetate, 1,2-diacetoxypropane, 3-dimethyl-3-methoxy-1-propanol, 1,3-dimethylbutyl glyceryl ether, pentyl glyceryl ether and hexyl glyceryl ether.

Among these compounds, n-hexanol, benzyl alcohol, 2-phenoxyethanol, 2-benzyloxyethanol, diethylene glycol monophenyl ether, triethylene glycol monophenyl ether, nonane-1,9-diol, 2-propoxy-1-propanol, dipropylene glycol monopropyl ether and pentyl glyceryl ether are preferable.

[Softener Composition]

The softener composition (I) of the present invention comprises the component (a) in an amount of preferably 3 to 40% by weight, more preferably 5 to 40% by weight and particularly preferably 5 to 35% by weight, most preferably from not less than 5% by weight to less than 20% by weight, the component (b) in an amount of preferably 0.5 to 30% by weight, more preferably 1 to 25% by weight and particularly preferably 2 to 20% by weight, most preferably 2 to 9.5% by weight, and the component (c) in an amount of preferably 0.5 to 40% by weight, more preferably 5 to 40% by weight, still more preferably 5 to 35% by weight and particularly preferably 5 to 30% by weight for the purpose of obtaining transparent appearance. Also, it is desirable that the ratio by mol of the component (a)/component (b) be 9/1 to 4/6, further 9/1 to 5/5, particularly 8.5/1.5 to 5.5/4.5 and most preferably 8.5/1.5 to 6.5/3.5 from the point of view of flexibility and feeling. Moreover, it is preferable to contain the component (a) and the component (b) in a total amount of 5 to 60% by weight and preferably 10 to 50% by weight, more preferably 15 to 50%by weight, especially preferably from more than 15% by weight to less than 30% by weight from the point of view of softening effect and storage stability.

The amounts and ratio of (a") and (b") contained in the embodiment (II) are the same as the above.

In the softener compositions (I) and (II) of the present invention, the aforementioned water is preferably distilled water or ion exchange water. Water is compounded in the composition in an amount of 30 to 95% by weight and preferably 50 to 85% by weight from the point of view of storage stability.

The composition of the present invention has a pH of preferably 1 to 8.5 and more preferably 1 to 8 from the point of view of storage stability and 2 to 8, more preferably 2 to 5 from the point of view of softening ability and feeling.

In the present invention, it is desirable to contain, in addition to the above essential components, a saturated or unsaturated fatty acid having 12 to 36, preferably 14 to 24 and more preferably 14 to 20 carbon atoms or its salt as the component (d) with the view of improving softening effect and feeling. To state in detail, examples of the fatty acid include lauric acid, myristic acid, palmitic acid, stearic acid, oleic acid or mixtures of these acids. Particularly, one or more types selected from palmitic acid, stearic acid and oleic acid are preferable. Also, fatty acids having an alkyl composition derived from palm oil and beef tallow are preferable. When a salt is used, sodium salt, potassium salt and magnesium salt are preferable. Particularly, sodium salt and magnesium salt are preferable in view of storage stability. The amount of the above fatty acid or its salt (d) to be compounded is preferably 0.01 to 5% by weight and particularly preferably 0.05 to 3% by weight in the composition. Also, the ratio of the component (d)/the component (a) or the ratio of the component (d)/the component (a') is 1/500 to 1/10 and preferably 1/300 to 1/50 in view of softening effect.

In the present invention, it is desirable to contain, in addition to the above essential components, a nonionic surfactant from the point of view of storage stability as the component (e). As the nonionic surfactant, at least one selected from a polyoxyethylene alkyl ether having an alkyl or alkenyl group having 8 to 20 carbon atoms, a polyoxyethylenealkylamine, a polyoxyethylenealkylamide, an alkylene oxide adduct to fats or oils or partial hydrolysis product of fats or oils and a condensation product of fats or oils, glycerin and an alkylene oxide is preferable and, particularly, a nonionic surfactant represented by the following formula (6) is preferable.

$$R^{25}—T—[(R^{26}O)_g—H]_h \quad (6)$$

wherein $R^{25}$ represents an alkyl group or an alkenyl group having 10 to 18 and preferably 12 to 18 carbon atoms, $R^{25}$ represents an alkylene group having 2 to 3 carbon atoms and preferably an ethylene group, g denotes a number of 2 to 100, preferably 5 to 80 and particularly preferably 10 to 60, T represents —O—, —CON— or —N— and h denotes 1 when T is —O— whereas h denotes 1 or 2 when T is —CON— or —N—.

As specific examples of the compound of the formula (6), the following compounds may be given.

$$R^{25}—O—(C_2H_4O)_r—H$$

wherein $R^{25}$ has the same meaning as above and r denotes a number of 8 to 100 and preferably 10 to 60.

$$R^{25}O—(C_2H_4O)_s—(C_3H_6O)_t—H$$

wherein $R^{25}$ has the same meaning as above, s and t respectively denotes a number of 2 to 40 and preferably 5 to 40 and EO and propylene oxide may be either a random or block adduct.

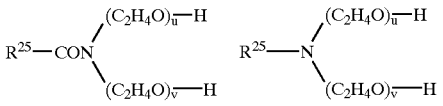

wherein $R^{25}$ has the same meaning as above, u and v respectively denotes a number of 0 to 40 and preferably 5 to 40 provided that u+v is a number of 5 to 60 and preferably 5 to 40, EO and propylene oxide may be either a random or block adduct.

The amount of the nonionic surfactant as the component (e) to be compounded in the composition is 0.5 to 10% by weight and particularly 1 to 8% by weight from the point of view of stability.

Also, the softener composition of the present invention may contain an inorganic salt as the component (f). As the inorganic salt, magnesium chloride is preferable from the point of view of storage stability. It is desirable to add the inorganic salt in an amount of zero to 3 percent by weight. When the component (c) is present in the composition, the amount of (f) is preferably zero to 2 wt. %, more preferably 0.1 to 1 wt. %, especially preferably 0.1 to 0.5 wt. %, the most preferably 0.2 to less than 0.5 wt. %. When the component (c) is not present in the composition, the amount of (f) is preferably zero to 1 wt. %, more preferably zero to 0.5 wt. %, especially preferably zero to 0.3 wt. %, the most preferably 0.0001 to 0.2 wt. %. It is to be noted that although surfactants such as fatty acid salts contain sodium salts and potassium salts, inorganic salts to be mixed in the composition resulting from the use of such a surfactant are free from the above limitation.

Also, the softener composition of the present invention can use a solvent other than the above component (c) without any problem. However it is important not to impair the effect of the present invention. As the solvent [hereinafter referred to as a component (c')] which may be used other than the above component (c), a solvent selected from ethanol, isopropanol, glycerol, ethylene glycol and propylene glycol is preferable and particularly ethanol is preferable from the point of view of fragrance. The component (c') may be compounded in the composition in an amount of 0 to 20% by weight and particularly 0.5 to 10% by weight. It is to be noted that when using ethanol, it is preferable to use polyoxyethylene alkyl ether sulfate modified ethanol or 8-acetylated cane sugar modified ethanol.

In the present invention, an ester compound of a saturated or unsaturated fatty acid having 8 to 22 carbon atoms and a polyhydric alcohol may be compounded as the component (g) for the purpose of improving the storage stability. However, it is necessary to pay special attention to obtain transparent appearance. As examples of the compound which maybe compounded, triglyceride, diglyceride, monoglyceride mono-, di- or tri-esters of pentaerythritol and sorbitan ester may be given. The amount of the compound to be added is preferably 5% by weight or less, more preferably 3% by weight or less and particularly preferably 1% by weight or less.

A generally known sequestering agent and antioxidant may be compounded in the softener composition of the present invention in order to improve the color and fragrance of the composition after the composition is stored. Examples of the sequestering agent include aminocarboxylic acids represented by ethylenediamine tetraacetate, diethylenetriamine pentaacetate and the like, inorganic phosphorous compounds represented by tripolyphosphate and pyrophosphate and organic phosphoric acids represented by 1-hydroxyethane-1,1-diphosphonate, polyphosphonic acids and phytic acid. Examples of the antioxidant include 2,6-di-tert-butyl-4-methylphenol and 2(3)-butyl-4-oxyanisole. These compounds may be compounded either as an acid or as a salt. These sequestering agent and antioxidant are compounded in the softening composition of the present invention in an amount ranging from 0.1 to 1000 ppm based on the weight of the component (a) or (a')

Silicone, perfumes (particularly preferably, a combination of fragrant components as shown in the components (c) and (d) described in the publication of JP-A No. 8-113871) and pigments which are usually compounded in a fiber treating agent may be compounded in the softener composition of the present invention.

As a method for the production of the softener composition (I) of the present invention, a method in which the component (c) and, as required, the component (e) are dissolved in water, the mixture is heated to raise the temperature to 40 to 70° C. and preferably 45° C. to 65° C., thereafter the component (a), the component (b) and, as required, the component (d), the component (f) and the component (g) are added to the mixture, which is then mixed with stirring, adjusted to a predetermined pH by using an acid agent and cooled and then other components are added to the resulting mixture is preferable from the point of view of storage stability.

As a method for the production of the softener composition (II) of the present invention, a method in which the component (c), the component (c') and the component (e) are dissolved in water according to the need, the mixture is heated to raise the temperature to 40 to 70° C. and preferably 45° C. to 65° C., thereafter the component (a), the component (b) and, as required, the component (d), the component (g) and the component (f) are added to the mixture, which is then mixed with stirring, adjusted to a predetermined pH by using an acid agent and cooled and then other components are added to the resulting mixture is preferable from the point of view of storage stability.

SYNTHETIC EXAMPLE OF THE EMBODIMENT (I)

Synthetic Example 1

Synthesis of (a-1)

(a-1) was synthesized by a dehydrating esterification reaction between a mixed fatty acid prepared by mixing palmitic acid/stearic acid in a ratio of 50/50 (weight ratio) and N-hydroxyethyl-N,N-dimethylamine. Specifically, a four-neck flask equipped with a stirrer, a temperature gage and a dewatering pipe was charged with 132 g of N-hydroxyethyl-N,N-dimethylamine, 200 g of palmitic acid and 200 g of stearic acid and the mixture was raised to 150° C. The mixture was heated under stirring at this temperature for 4 hours while distilling generated water. The resulting mixture was raised to 180° C. and continuously heated with stirring for 10 hours while 66 g of 2-dimethylaminoethanol was added dropwise. After that, the reaction mixture was cooled to 120° C. and unreacted amine was distilled under reduced pressure to obtain 473 g of the target N-alkanoyloxyethyl-N,N-dimethylamine (a-1).

Synthetic Example 2

Synthesis of (a-2)

(a-2) was synthesized by a de-methanol amidation reaction between methyl stearate and N,N-dimethyl-1,3-propanediamine. Specifically, a four-neck flask equipped with a stirrer, a temperature gage and a dewatering pipe was charged with 161 g of N,N-dimethyl-1,3-propanediamine and 448 g of methyl stearate and the mixture was raised to 180° C. The mixture was heated under stirring at this temperature for about 5 hours while distilling generated methanol. The reaction mixture was cooled to 120° C. and unreacted amine was distilled under reduced pressure to obtain 545 g of the target N-stearoylaminopropyl-N,N-dimethylamine (a-2).

Synthetic Example 3

Synthesis of (a-3)

(a-3) was synthesized using the component (a-1) produced in the above Synthetic Example 1 and methyl chloride. Specifically, an autoclave was charged with 100 g of the component (a-1) and 300 g of ethanol and the mixture was raised to 100° C. with stirring after the atmosphere in the autoclave was replaced by nitrogen. Thereafter, 18 g of methyl chloride was introduced into the autoclave under pressure and the resulting mixture was reacted for 3 hours. The reaction mixture was cooled and then ethanol was distilled under reduced pressure to obtain the target N-alkanoyloxyethyl-N,N,N-trimethylammonium chloride (a-3).

Synthetic Example 4

Synthesis of (a-4)

A synthetic operation was carried out using the component (a-2) produced in the above Synthetic Example 2 and methyl chloride in the same manner as in Synthetic Example 3 to obtain the target N-stearoylaminopropyl-N,N,N-trimethylammonium chloride (a-4).

Synthetic Example 5

Synthesis of (a-5)

(a-5) was synthesized by a dehydrating esterification reaction between stearic acid and N,N-dimethyl-1,3-propanediamine. Specifically, a four-neck flask equipped with a stirrer, a temperature gage and a dewatering pipe was charged with 120 g of N,N-dimethyl-1,3-propanediamine, 284 of stearic acid and 0.12 g of sodium borohydride and the mixture was raised to 180° C. The mixture was heated under stirring at this temperature for about 5 hours while distilling generated water and a part of N,N-dimethyl-1,3-propanediamine to be distilled together with water. The reaction mixture was then cooled to 120° C. and unreacted amine was distilled under reduced pressure (10 torr) to obtain 368 g of the target N-stearoylaminopropyl-N,N-dimethylamine (a-5).

EXAMPLES OF THE EMBODIMENT (I)

<Components to be Compounded>

The components used in Examples are shown below.

(a-1): N-alkanoyloxyethyl-N,N-dimethylamine obtained in Synthetic Example 1

(a-2): N-stearoylaminopropyl-N,N-dimethylamine obtained in Synthetic Example 2

(a-3): N-alkanoyloxyethyl-N,N,N-trimethylammonium chloride obtained in Synthetic Example 3

(a-4): N-stearoylaminopropyl-N,N,N-trimethylammonium chloride obtained in Synthetic Example 4

(a'-1): N,N-distearoyloxyethyl-N,N-dimethylammonium chloride (a'-2): N,N-dioleoyloxyethyl-N,N-dimethylammonium chloride (b-1): Sodium stearyl sulfate (b-2): Sodium polyoxyethylene hydrogenated beef tallow composition alkyl sulfate (EO average addition mol number: 23, hydrogenated beef tallow composition: palmityl group/stearyl group (ratio by weight of 40/60)

(b'-1): Sodium alkyl (12 to 14 carbon atoms)benzene sulfonate (c-1): Pentyl glyceryl ether (log P=0.54)

(c-2): Dipropylene glycol monopropyl ether (log P=0.99)

(c-3): Triethylene glycol monophenyl ether (log P=1.32)

(c-4): n-Hexanol (log P=1.88)

(c-7): n-Propanol (log P=0.29)

(c'-2): Ethylene glycol (log P=−1.36)

(c'-3): Ethanol (log P=−0.31)

(d-1): Stearic acid (e-1): EO-addition (20 mols in average) saturated alcohol having 12 carbon atoms (e-2): EO-addition (30 mols in average) stearylamine (f-1): Magnesium Chloride (g-1): Excel 150 [mixture of stearic acid mono-, di- and tri-glycerides (mono:di:tri=60:35:5), manufactured by Kao Corporation]

(h-1): Silicone (TSF4452, manufactured by GE Toshiba Silicones Co., Ltd.)

(h-2): Dye (Acid Blue 9)

(h-3): Perfume [Mixture of hexylcinnamicaldehyde (18), nerolin yarayara (4), tricyclodecenyl acetate (4), benzyl acetate (10), musk ketone (5), anisil acetone (2), sandal mysole core (2), aldehyde C14 peach (1), linalool (18), dihydroxymyrsenol (8), borneol (4), cedrol (4), mugol (5), benzyl alcohol (5) and dipropylene glycol (10): numerals in the parentheses indicate wt % in the perfume]

(h-4): 2,6-di-t-butyl-4-methylphenol (Method of the Preparation of the Softener Composition)

The softener compositions shown in Table 1 and Table 2 were prepared using the above components. At this time, the component (c) and the component (e) were dissolved in water and the temperature was raised up to 60° C. To the mixture were added the component (a), the component (b), the component (d), the component (f) and the component (g) while stirring the mixture by using a stirring blade at 60° C. After the resulting mixture was adjusted to a predetermined pH by using an aqueous 35% hydrochloric acid solution and an aqueous 48% sodium hydroxide solution. Then, the remainder (h) component was added and the resulting mixture was cooled to ambient temperature. It is to be noted that almost all of these (a-1) and (a-2) components exist in the state of hydrochloride in the composition in the pH range shown in Table 1 and Table 2.

(Softening Treatment)

Five bath towels (100% cotton) were washed using a commercially available weak-alkaline detergent (Attack, manufactured by Kao Corporation) in a washer (Two-bath type washer VH-360S1, manufactured by Toshiba Corporation, Detergent concentration: 0.0667% by weight, city water used: 30 L, water temperature: 20° C., 10 minutes). Then, the detergent solution was drained away, the towels were dewatered for 30 minutes, 30 L of city water was poured into the washer and then, the towels were rinsed for 5 minutes. After water was drained, the towels were dewatered for 3 minutes. Thereafter, 30 L of city water was again poured into the washer and then 7 ml of the softener composition shown in Table 1 or Table 2 was added, followed by stirring for 5 minutes. After that, the bath towels were dewatered and air-dried.

(Evaluation of Flexibility and Feeling)

The flexibility and feeling of the clothes treated above were judged according to the following standard by 10 panelists (10 men, 30 years-age) to calculate an average. The case where the average was 0 or more and less than 1 was judged to be ○, the case where the average was 1 or more and less than 1.5 was judged to be Δ and the case where the average was 1.5 or more was judged to be ×. The results are shown in Table 1 and Table 2.

| | | |
|---|---|---|
| (1) | Standard of evaluation of flexibility | |
| | Finished very softly | 0 |
| | Finished softly | 1 |
| | Finished slightly softly | 2 |
| | Not finished softly | 3 |
| (2) | Standard of evaluation of feeling | |
| | Not oily but fresh feeling | 0 |
| | Less oily and fresh feeling | 1 |
| | Slightly oily feeling | 2 |
| | Oily feeling | 3 |

(Evaluation of the Outward Appearance of the Composition)

100 ml of each composition shown in Table 1 and Table 2 was poured into a wide-mouthed standard bottle PS No. 11 and the outward appearance of the composition was evaluated visually. The case where the composition was a transparent liquid was evaluated as ○, the case where the composition was a liquid which was seen turbid was evaluated as □, the case where the composition was turbid was evaluated as Δ and the case where precipitates were generated was evaluated as ×.

TABLE 1

| | Formulation example | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Softener composition Component to be compounded (wt %) | | | | | | | | | | | | |
| (a-1) | 16 | | | | | | | | | | | |
| (a-2) | | 16 | | | | | | | | | | |
| (a-3) | | | 16 | | | | | | | | | |
| (a-4) | | | | 16 | 16 | 16 | 4 | 16 | 16 | | | |
| (a'-1) | | | | | | | | | | 16 | 16 | |
| (a'-2) | | | | | | | | | | | | 16 |
| (b-1) | 4 | 4 | 4 | 4 | | | | | | 4 | | |
| (b-2) | | | | | 4 | 4 | 16 | | 4 | | | |
| (b'-1) | | | | | | | | 4 | | | | |
| (c-1) | 10 | | | 10 | | | | | | 10 | | |
| (c-2) | | 10 | | | 10 | | 10 | 10 | | | | |
| (c-3) | | | 10 | | | | | | | | 10 | 10 |
| (c-4) | | | | | | 10 | | | | | | |
| (c-7) | | | | | | | | | 10 | | | |

TABLE 1-continued

| | Formulation example | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| (c'-2) | 2 | 2 | 2 | 2 | 2 | 2 | 2 | 2 | 2 | 2 | 2 | 2 |
| (d-1) | 0.2 | 0.2 | 0.2 | 0.2 | 0.2 | 0.2 | 0.2 | 0.2 | 0.2 | 0.2 | 0.2 | 0.2 |
| (e-1) | 3 | | 3 | | 3 | 3 | 3 | 3 | 3 | 3 | | |
| (e-2) | | 3 | | 3 | | | | | | | 3 | 3 |
| (f-1) | 0.3 | 0.3 | 0.3 | 0.3 | 0.3 | 0.3 | 0.3 | 0.3 | 0.2 | 0.3 | 0.3 | 0.3 |
| (g-1) | 0.1 | 0.1 | 0.1 | 0.1 | 0.1 | 0.1 | 0.1 | 0.1 | 0.1 | 0.1 | 0.1 | 0.1 |
| (h-1) | 0.5 | 0.5 | 0.5 | 0.5 | 0.5 | 0.5 | 0.5 | 0.5 | 0.5 | 0.5 | 0.5 | 0.5 |
| (h-2) | 0.0003 | 0.0003 | 0.0003 | 0.0003 | 0.0003 | 0.0003 | 0.0003 | 0.0003 | 0.0003 | 0.0003 | 0.0003 | 0.0003 |
| (h-3) | 0.5 | 0.5 | 0.5 | 0.5 | 0.5 | 0.5 | 0.5 | 0.5 | 0.5 | 0.5 | 0.5 | 0.5 |
| Ion exchange water | Balance | Balance | Balance | Balance | Balance | Balance | Balance | Balance | Balance | Balance | Balance | Balance |
| Total | 100 | 100 | 100 | 100 | 100 | 100 | 100 | 100 | 100 | 100 | 100 | 100 |
| pH (20° C.) | 3.0 | 6.0 | 3.0 | 6.0 | 6.0 | 6.0 | 6.0 | 6.0 | 6.0 | 3.0 | 3.0 | 3.0 |
| (a)/(b) molar ratio | 81/19 | 80/20 | 79/21 | 77/23 | 81/19 | 81/19 | 21/79 | 76/34 | 81/19 | 67/33 | — | — |
| Softening effect | ○ | ○ | ○ | ○ | ○ | ○ | X | X | ○ | ○ | ○ | ○ |
| Feeling effect | ○ | ○ | ○ | ○ | ○ | ○ | ○ | ○ | ○ | ○ | X | X |
| Evaluation of outward appearance | ○ | ○ | ○ | ○ | ○ | □ | X | ○ | X | X | X | □ |

Evaluation of Outward Appearance

In the case of Formulation Example 10 in Table 1, the molar ratio of (a)/(b) was calculated by placing (a'-1) as the component (a) and (b'-1) as the component (b).

In the case of Formulation Example 23 in Table 2, the molar ratio of (a)/(b) was calculated by placing (a'-1) as the component (a).

TABLE 2

| | Formula example | | | | | | | | | | |
|---|---|---|---|---|---|---|---|---|---|---|---|
| | 13 | 14 | 15 | 16 | 17 | 18 | 19 | 20 | 21 | 22 | 23 |
| Softener composition Component to be compounded (wt %) | | | | | | | | | | | |
| (a-1) | 20 | | | | 20 | 20 | | | | | |
| (a-2) | | 20 | | | | | 20 | | | | |
| (a-3) | | | 20 | | | | | 20 | | | |
| (a-4) | | | | 25 | | | | | 25 | 20 | |
| (a'-1) | | | | | | | | | | | |
| (a'-2) | | | | | | | | | | | 20 |
| (b-1) | 6 | | 6 | | 6 | 6 | | 6 | | | 6 |
| (b-2) | | 6 | | 5 | | | 6 | | 5 | | |
| (b'-1) | | | | | | | | | | 6 | |
| (c-1) | 30 | | | | 10 | | | | | 30 | |
| (c-2) | | 25 | | | | | | | | | 30 |
| (c-3) | | | 30 | | | | | | | | |
| (c-4) | | | | 20 | | | | | | | |
| (c-7) | | | | | | 30 | | | | | |
| (c'-2) | | | | | | | 25 | | | | |
| (c'-3) | 2 | 2 | 2 | 2 | 2 | | | 30 | 40 | | |
| (d-1) | 0.2 | 0.2 | 0.2 | 0.2 | 0.2 | 0.2 | 0.2 | 0.2 | 0.2 | 0.2 | 0.2 |
| (e-1) | 3 | | 3 | | 3 | 3 | | 3 | | 3 | |
| (e-2) | | 3 | | 3 | | | 3 | | 3 | | 3 |
| (f-1) | 0.3 | 0.3 | 0.3 | 0.3 | 0.3 | 0.02 | 0.02 | 0.02 | 0.3 | 0.3 | |
| (g-1) | 0.1 | 0.1 | 0.1 | 0.1 | 0.1 | 0.1 | 0.1 | 0.1 | 0.1 | 0.1 | 0.1 |
| (h-1) | 0.5 | 0.5 | 0.5 | 0.5 | 0.5 | 0.5 | 0.5 | 0.5 | 0.5 | 0.5 | 0.5 |
| (h-2) | 0.0003 | 0.0003 | 0.0003 | 0.0003 | 0.0003 | 0.0003 | 0.0003 | 0.0003 | 0.0003 | 0.0003 | 0.0003 |
| (h-3) | 0.5 | 0.5 | 0.5 | 0.5 | 0.5 | 0.5 | 0.5 | 0.5 | 0.5 | 0.5 | 0.5 |
| (h-4) | 500 ppm | 500 ppm | 500 ppm | 500 ppm | 500 ppm | 500 ppm | 500 ppm | 500 ppm | 500 ppm | 500 ppm | 500 ppm |
| Ion exchange water | balance | balance | Balance | Balance | Balance | Balance | Balance | Balance | Balance | Balance | Balance |
| Total | 100 | 100 | 100 | 100 | 100 | 100 | 100 | 100 | 100 | 100 | 100 |
| pH (20° C.) | 3.0 | 3.0 | 3.0 | 3.0 | 3.0 | 3.0 | 3.0 | 3.0 | 3.0 | 3.0 | 3.0 |
| (a)/(b) molar ratio | 78/22 | 81/19 | 76/24 | 85/15 | 78/22 | 78/22 | 81/19 | 76/24 | 85/15 | 73/27 | 64/36 |
| Softening effect | ○ | ○ | ○ | ○ | ○ | X | X | X | X | X | X |
| Feeling effect | ○ | ○ | ○ | ○ | ○ | ○ | ○ | ○ | ○ | X | X |
| Evaluation of outward appearance | ○ | ○ | ○ | □ | ○ | □ | X | X | X | ○ | ○ |

Using (a-5), Formulation Examples 31 to 36 were obtained according to the formulations as shown in Table 3 and evaluated in the same manner as above.

TABLE 3

| | 31 | 32 | 33 | 34 | 35 | 36 |
|---|---|---|---|---|---|---|
| a-5 | 16 | 16 | 16 | 16 | 16 | 16 |
| b"-4 | 4 | 4 | 4 | 4 | 4 | 4 |
| c-3 | 25 | | | | | 1 |
| c-6 | | 15 | | 15 | 15 | 12 |
| c-5. | | | 15 | | | 2 |
| c'-3 | | | | 2 | 2 | 2 |
| d-1 | | | | 0.2 | 0.2 | 0.2 |
| f-1 | 0.3 | 0.3 | 0.3 | 0.3 | 0.3 | 0.3 |
| g-1 | | | | 0.1 | 0.1 | 0.1 |
| h-1 | | | | 0.5 | 0.5 | 0.5 |
| h-2 | 0.0003 | 0.0003 | 0.0003 | 0.0003 | 0.0003 | 0.0003 |
| h-3 | 0.5 | 0.5 | 0.5 | 0.5 | 0.5 | 0.5 |
| h-4 | | | | 0.1 | 0.1 | 0.1 |
| Ion exchange water | Balance | Balance | Balance | Balance | Balance | Balance |
| Total | 100 | 100 | 100 | 100 | 100 | 100 |
| pH (20° C.) | 3.0 | 3.0 | 3.0 | 3.0 | 4.5 | 3.0 |
| (a)/(b) molar ratio | 83/17 | 83/17 | 83/17 | 83/17 | 83/17 | 83/17 |
| Softening effect | ○ | ○ | ○ | ○ | ○ | ○ |
| Feeling effect | ○ | ○ | ○ | ○ | ○ | ○ |
| appearance | ○ | ○ | ○ | ○ | ○ | ○ |

a-5: N-Stearoylaminopropyl-N,N-dimethylamine
b"-4: Sodium Guerbet type alkyl (24 carbon atoms) sulfate
c-3: Triethylene glycol monophenyl ether (logP = 1.32)
c-5: Diethylene glycohl mono phenyl ether
c'-3: ethanol (log = 0.31)
d-1 to h-4 are same as table 1

SYNTHETIC EXAMPLE OF EMBODIMENT (II)

Synthetic Example 11

Synthesis of (a"-1)

(a"-1) was synthesized by a dehydrating esterification reaction between oleic acid and N-hydroxyethyl-N,N-dimethylamine. Specifically, a four-neck flask equipped with a stirrer, a temperature gage and a dewatering pipe was charged with 132 g of N-hydroxyethyl-N,N-dimethylamine and 400 g of oleic acid and the mixture was raised to 150° C. The mixture was heated under stirring at this temperature for 4 hours while distilling generated water. The resulting mixture was raised to 180° C. and continuously heated with stirring for 10 hours while 66 g of 2-dimethylaminoethanol was added dropwise. After that, the reaction mixture was cooled to 120° C., unreacted amine was distilled under reduced pressure and the reaction mixture was subjected to distillation to obtain 350 g of the target N-oleoyloxyethyl-N,N-dimethylamine (a"-1).

Synthetic Example 12

Synthesis of (a"-2)

(a"-2) was synthesized by a de-methanol amidation reaction between a mixed fatty acid prepared by mixing palmitic acid/stearic acid in a ratio of 40/60 (weight ratio) and N,N-dimethyl-1,3-propanediamine. Specifically, a four-neck flask equipped with a stirrer, a temperature gage and a dewatering pipe was charged with 161 g of N,N-dimethyl-1,3-propanediamine and 448 g of stearic acid and the mixture was raised to 180° C. The mixture was heated under stirring at this temperature for about 5 hours while distilling generated methanol. After that, the reaction mixture was cooled to 120° C., unreacted amine was distilled under reduced pressure and the mixture was subjected to distillation to obtain 445 g of the target N-alkanoylaminopropyl-N,N-dimethylamine (a"-2).

Synthetic Example 13

Synthesis of (a"-3)

(a"-3) was synthesized using the component (a"-1) produced in the above Synthetic Example 11 and methyl chloride. Specifically, an autoclave was charged with 100 g of the component (a"-1) and 300 g of ethanol and the mixture was raised to 100° C. with stirring after the atmosphere in the autoclave was replaced by nitrogen. Thereafter, 18 g of methyl chloride was introduced into the autoclave under pressure and the resulting mixture was reacted for 3 hours. The reaction mixture was cooled and then ethanol was distilled under reduced pressure to obtain the target N-oleoyloxyethyl-N,N,N-trimethylammonium chloride (a"-3).

Synthetic Example 14

Synthesis of (a"-4)

A synthetic operation was carried out using the component (a"-2) produced in the above Synthetic Example 12 and methyl chloride in the same manner as in Synthetic Example 13 to obtain the target N-alkanoylaminopropyl-N,N,N-trimethylammonium chloride (a"-4).

Synthetic Example 15

Synthesis of (a"-5)

N-oleoylaminopropyl-N,N-dimethylamine (a"-5) was obtained in the same manner as in Synthetic Example 12 except that oleic acid was used in place of the mixed fatty acid.

Synthetic Example 16

Synthesis of (a"-6)

A synthetic operation was carried out using oleoylaminopropyl-N,N-dimethylamine synthesized in the above Synthetic Example 15 and methyl chloride in the same manner as in Synthetic Example 13 to obtain the target N-oleoylaminopropyl-N,N,N-trimethylammonium chloride (a"-6).

EXAMPLES OF EMBODIMENT (II)

<Component to be Compounded>

(a"-1): N-oleoyloxyethyl-N,N-dimethylamine obtained in Synthetic Example 11

(a"-2): N-alkanoylaminopropyl-N,N-dimethylamine obtained in Synthetic Example 12

(a"-3): N-oleoyloxyethyl-N,N,N-trimethylammonium chloride obtained in Synthetic Example 13

(a"-4): N-alkanoylaminopropyl-N,N,N-trimethylammonium chloride obtained in Synthetic Example 14

(a"-5): N-oleoylaminopropyl-N,N-dimethylamine obtained in Synthetic Example 15

(a"-6): N-oleoylaminopropyl-N,N,N-trimethylammonium chloride obtained in Synthetic Example 16

(a"'-1): N,N-distearoyloxyethyl-N,N-dimethylammonium chloride (a"'-2):N,N-dioleoylaminopropyl-N,N-dimethylammonium chloride (b"-1): Sodium Guerbet type alkyl (20 carbon atoms) sulfate (Sodium Guerbet-alcohol sulfate obtained by sulfurizing 2-octyl-1-dodecanol obtained by a Guerbet reaction from decanol using sulfur trioxide and by further neutralizing the sulfate using sodium hydroxide)

(b"-2): Sodium polyoxyethylene beef tallow composition alkyl sulfate (EO average addition mol number: 2.3, beef tallow composition: palmityl group/stearyl group (ratio by weight: 40/60)

(b"-3): Sodium stearyl sulfate (b"-4): Sodium Guerbet type alkyl (24 carbon atoms) sulfate (Sodium Guerbet-alcohol sulfate obtained by sulfurizing 2-decyl-1-tetradecanol obtained by a Guerbet reaction from dodecanol using sulfur trioxide and by further neutralizing the sulfate using sodium hydroxide)

(c-3): Triethylene glycol monophenyl ether (log P=1.32)

(c-6): Phenoxyethanol (log P=1.19)

(c'-2): Ethylene glycol (c'-4): 8-Acetyllated cane sugar modified ethanol (d-1): Stearic acid (d-2): Oleic acid (e-1): EO (average 20 mol) addition saturated alcohol having 12 carbon atoms (e-2): EO (average 30 mol) addition stearylamine (f-1): Magnesium chloride (g-1): Mixture of oleic acid mono-, di- and tri-glycerides (mono:di:tri=60:35:5)

(h-1), (h-2) and (h-3) are the same as above.

(Method of the Preparation of the Softener Composition)

The softener compositions shown in Table 4 and Table 5 were prepared using the above components. At this time, the component (c), the component (c') and the component (e) were dissolved in water and the temperature was raised up to 60° C. To the mixture were added the component (a"), the component (b"), the component (d), the component (g) and the component (f) while stirring the mixture by using a stirring blade at 60° C. The resulting mixture was adjusted to a predetermined pH by using an aqueous 35% hydrochloric acid solution and an aqueous 48% sodium hydroxide solution. Then, the remainder component (h) was added and the resulting mixture was cooled to ambient temperature. It is to be noted that almost all of these (a"-1) (a"-2) and (a"-5) components exist in the state of hydrochloride in the composition in the pH range shown in Table 4 and Table 5.

Softening treatment, the evaluation of flexibility and feeling and the evaluation of the outward appearance of the composition were carried out in the same manner as above.

TABLE 4

| | Formulation example | | | | | | | | | | | | | |
|---|---|---|---|---|---|---|---|---|---|---|---|---|---|---|
| | 101 | 102 | 103 | 104 | 105 | 106 | 107 | 108 | 109 | 110 | 111 | 112 | 113 | 114 |
| Softener composition Component to be compounded (wt %) | | | | | | | | | | | | | | |
| (a"-1) | 16 | | | | | | | | | | | | | |
| (a"-2) | | 16 | | | | | | | | | | | | |
| (a"-3) | | | 16 | | | | | | | | | | | |
| (a"-4) | | | | 16 | | | | 16 | 19 | 4 | | | | |
| (a"-5) | | | | | 16 | | | | | | | | | |
| (a"-6) | | | | | | 16 | 16 | | | | | | | |
| (a"'-1) | | | | | | | | | | | 16 | | 16 | 16 |
| (a"'-2) | | | | | | | | | | | | 16 | | |
| (b"-1) | | 4 | | 4 | | | | | 1 | 16 | 4 | | | |
| (b"-2) | 4 | | 4 | | 4 | 4 | | | | | | | | |
| (b"-3) | | | | | | | 4 | 4 | | | | 4 | | |
| (c-3) | | | 10 | 10 | | | 10 | 10 | | | 10 | 10 | 10 | |
| (c-6) | 10 | 10 | | | 10 | 10 | | | 10 | 10 | | | | |
| (c'-2) | 1 | 1 | 1 | 1 | 1 | 1 | 1 | 1 | 1 | 1 | 1 | 1 | 1 | 1 |
| (d-1) | | 0.2 | | 0.2 | | | | 0.2 | 0.2 | 0.2 | 0.2 | | 0.2 | 0.2 |
| (d-2) | 0.2 | | 0.2 | | 0.2 | 0.2 | 0.2 | | | | | 0.2 | | |
| (e-1) | 3 | | 3 | | 3 | | 3 | | 3 | | 3 | | 3 | 3 |
| (e-2) | | 3 | | 3 | | 3 | | 3 | | 3 | | 3 | | |
| (f-1) | 0.3 | 0.3 | 0.3 | 0.3 | 0.3 | 0.3 | 0.3 | 0.3 | 0.3 | 0.3 | 0.3 | 0.3 | 0.3 | 0.02 |
| (g-1) | 0.1 | 0.1 | 0.1 | 0.1 | 0.1 | 0.1 | 0.1 | 0.1 | 0.1 | 0.1 | 0.1 | 0.1 | 0.1 | 0.1 |
| (h-1) | 0.5 | 0.5 | 0.5 | 0.5 | 0.5 | 0.5 | 0.5 | 0.5 | 0.5 | 0.5 | 0.5 | 0.5 | 0.5 | 0.5 |
| (h-2) | 0.0003 | 0.0003 | 0.0003 | 0.0003 | 0.0003 | 0.0003 | 0.0003 | 0.0003 | 0.0003 | 0.0003 | 0.0003 | 0.0003 | 0.0003 | 0.0003 |
| (h-3) | 0.5 | 0.5 | 0.5 | 0.5 | 0.5 | 0.5 | 0.5 | 0.5 | 0.5 | 0.5 | 0.5 | 0.5 | 0.5 | 0.5 |
| Ion exchange water | Balnce | Balnce | Balnce | Balnce | Balnce | Balnce | Balnce | Balnce | Balnce | Balnce | Balnce | Balnce | Balnce | Balnce |
| Total | 100 | 100 | 100 | 100 | 100 | 100 | 100 | 100 | 100 | 100 | 100 | 100 | 100 | 100 |
| pH (20° C.) | 3.0 | 3.0 | 3.0 | 6.0 | 2.5 | 6.0 | 6.0 | 6.0 | 6.0 | 6.0 | 3.0 | 6.0 | 3.0 | 3.0 |
| (a")/(b") molar ratio | 84/16 | 82/18 | 82/18 | 80/20 | 83/17 | 82/18 | 79/21 | 78/22 | 95/5 | 20/80 | 70/30 | 67/33 | — | — |
| Softening effect | Δ | ○ | Δ | ○ | Δ | Δ | Δ | ○ | X | X | X | X | ○ | ○ |
| Feeling effect | ○ | ○ | ○ | ○ | ○ | ○ | ○ | ○ | ○ | ○ | ○ | ○ | X | X |
| Evaluation of outward appearance | □ | □ | ○ | ○ | □ | ○ | ○ | X | ○ | Δ | X | X | X | X |

In the case of Formulation Examples 111 and 112 in Table 4, the molar ratio of (a")/(b") was calculated by placing (a"'-1) and (a"'-2) as the component (a").

TABLE 5

| | Formulation example | | | | | | | | | | |
|---|---|---|---|---|---|---|---|---|---|---|---|
| | 115 | 116 | 117 | 118 | 119 | 120 | 121 | 122 | 123 | 124 | 125 |
| Softener composition Component to be compounded (wt %) | | | | | | | | | | | |
| (a"-1) | 20 | | | | | | | | | | |
| (a"-2) | | 20 | | | | | | | | | |
| (a"-3) | | | 25 | | | | | | | | |
| (a"-4) | | | | 19 | 25 | | | 20 | | | |
| (a"-5) | | | | | | 20 | | | | | |
| (a"-6) | | | | | | | 20 | | | | 5 |
| (a"'-1) | | | | | | | | | 30 | | |
| (a"'-2) | | | | | | | | | | 30 | |
| (b"-1) | | | 5 | | | | | | | | |
| (b"-2) | | | | | 5 | | | | | 10 | |
| (b"-3) | | | | | | | 6 | | | | |
| (b"-4) | 6 | 6 | | 5 | | 8 | | 4 | | | 30 |
| (c-3) | 20 | 25 | 30 | 25 | | 25 | | | | | |
| (c-6) | | | | | 20 | | 25 | 10 | 30 | 30 | 25 |
| (c'-2) | 2 | | | | | | | | | | |
| (c'-4) | | 2 | 3 | 2 | 5 | 2 | 3 | 5 | 3 | 3 | 5 |
| (d-1) | | 0.2 | | 0.2 | 0.2 | | | 0.2 | 0.2 | | |
| (d-2) | 0.2 | | 0.2 | | | 0.2 | 0.2 | | | 0.2 | 0.1 |
| (e-1) | | 3 | | 3 | 3 | 3 | 3 | 3 | 3 | 3 | 3 |
| (e-2) | 3 | | 3 | | | | | | | | |
| (f-1) | 0.3 | 0.3 | 0.3 | 0.3 | 0.3 | 0.3 | 0.3 | 0.3 | 0.3 | 0.3 | 0.3 |
| (g-1) | 0.1 | 0.1 | 0.1 | 0.1 | 0.1 | 0.1 | 0.1 | 0.1 | 0.1 | 0.1 | 0.1 |
| (h-1) | 0.5 | 0.5 | 0.5 | 0.5 | 0.5 | 0.5 | 0.5 | 0.5 | 0.5 | 0.5 | 0.5 |
| (h-2) | 0.0003 | 0.0003 | 0.0003 | 0.0003 | 0.0003 | 0.0003 | 0.0003 | 0.0003 | 0.0003 | 0.0003 | 0.0003 |
| (h-3) | 0.5 | 0.5 | 0.5 | 0.5 | 0.5 | 0.5 | 0.5 | 0.5 | 0.5 | 0.5 | 0.5 |
| (h-4) | 500 ppm | 500 ppm | 500 ppm | 500 ppm | 500 ppm | 500 ppm | 500 ppm | 500 ppm | 500 ppm | 500 ppm | 500 ppm |
| Ion exchange water | Balance | Balance | Balance | Balance | Balance | Balance | Balance | Balance | Balance | Balance | Balance |
| Total | 100 | 100 | 100 | 100 | 100 | 100 | 100 | 100 | 100 | 100 | 100 |
| pH (20° C.) | 3.0 | 3.0 | 3.0 | 3.0 | 3.0 | 3.0 | 3.0 | 3.0 | 3.0 | 3.0 | 3.0 |
| (a")/(b") molar ratio | 81/19 | 81/19 | 83/17 | 81/19 | 78/22 | 76/24 | 77/23 | 85/15 | — | 68/32 | 15/85 |
| Softening effect | ○ | ○ | ○ | ○ | ○ | ○ | ○ | ○ | ○ | X | X |
| Feeling effect | ○ | ○ | ○ | ○ | ○ | ○ | ○ | ○ | X | ○ | ○ |
| Evaluation of outward appearance | ○ | ○ | ○ | ○ | X | ○ | ○ | ○ | X | ○ | X |

In the case of Formulation Examples 124 in Table 5, the molar ratio of (a")/(b") was calculated by placing (a"'-2) as the component (a").

What is claimed is:

1. A softener composition comprising (α) an amino compound or a quaternary ammonium-having compound, (β) an anionic surfactant and water, in which (α) and (β) form a complex with each other, and (α) and (β) being specified below as (I) or (II), at a mole ratio of (α)/(β) ranging from 9/1 to 5/5, further comprising an organic solvent having a log P of 0.2 to 3.0 when (α) and (β) are specified as (I):

(I) (a) a compound having one group selected from an amino group and a quaternary ammonium group and one hydrocarbon group having 8 to 36 carbon atoms in its molecule and (b) an anionic surfactant having a hydrocarbon group having 14 to 36 hydrocarbons and a —$SO_3M$ group and/or a —$OSO_3M$ group, M being a counter ion, in its molecule, or;

(II) (a") a compound having one group selected from an amino group and a quaternary ammonium group and one hydrocarbon group having 8 to 36 carbon atoms in its molecule and (b") an anionic surfactant having a hydrocarbon group having 8 to 36 carbon atoms and a —$SO_3M$ group and/or a —$OSO_3M$ group, M being a counter ion, in its molecule wherein at least one of (a") and (b") contains a hydrocarbon group selected from (1) a hydrocarbon group having one or more unsaturated bonds and 8 to 36 carbon atoms and (2) a branched alkyl group having 8 to 36 carbon atoms.

2. The composition as claimed in claim 1, in which (α) and (β) are (I) and (a) is selected from the group consisting of a tertiary amine having the formula (1), a salt thereof and a quaternary ammonium salt having the formula (2):

(1)

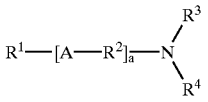

(2)

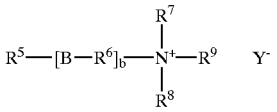

wherein $R^1$ and $R^5$ independently represent an alkyl group or an alkenyl group, having 8 to 36 carbon atoms, $R^2$ and $R^6$ independently represent an alkylene group having 1 to 6 carbon atoms, $R^3$, $R^4$, $R^7$, $R^8$ and $R^9$ independently represent an alkyl group or a hydroxyalkyl group, having 1 to 3 carbon atoms, A and B independently represent a group selected from —COO—, —OCO—, —CONH— and —NHCO—, a and b independently denote a number of 0 or 1 and $Y^-$ represents an anion.

3. The composition as claimed in claim 1, in which (α) and (β) are (II) and (a") is selected from the group consisting of a tertiary amine having the formula (1'), a salt thereof and a quaternary ammonium salt having the formula (2'):

(1')

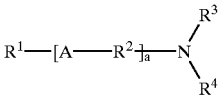

(2')

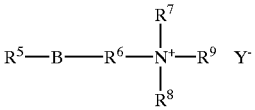

wherein $R^1$ and $R^5$ independently represent a group selected from (1) a hydrocarbon group having one or more unsaturated bond and 8 to 36 carbon atoms, (2) a branched alkyl group having 8 to 36 carbon atoms and (3) a straight-chain alkyl group having 8 to 36 carbon atoms and $R^2$, $R^6$, $R^3$, $R^4$, $R^7$, $R^8$, $R^9$, A, B, a and $Y^-$ are the same as those in claim 2.

* * * * *